US005370334A

United States Patent [19]

Shinkawa et al.

[11] Patent Number: 5,370,334

[45] Date of Patent: Dec. 6, 1994

[54] APPARATUS FOR DRIVING ROD ANTENNA ELEMENT FOR EXPANSION/CONTRACTION

[75] Inventors: Masaki Shinkawa; Nobuhiko Suzuki, both of Tokyo; Manabu Sakakibara; Norifumi Ogawa, both of Hiroshima, all of Japan

[73] Assignee: Harada Industry Co., Ltd., Tokyo, Japan

[21] Appl. No.: 960,548

[22] Filed: Oct. 13, 1992

[30] Foreign Application Priority Data

Oct. 17, 1991 [JP] Japan ..... 3-269439

[51] Int. Cl.[5] ..... H01Q 1/10; B65H 75/34

[52] U.S. Cl. ..... 242/390.2; 343/903

[58] Field of Search ..... 242/54 A, 54 R; 343/877, 901, 903; 464/41

[56] References Cited

U.S. PATENT DOCUMENTS

| | | | |
|---|---|---|---|
| 1,384,324 | 7/1921 | Kelly | 464/41 |
| 2,496,785 | 2/1950 | Finneburgh et al. | 343/903 X |
| 3,774,675 | 11/1973 | Yoshiro | 464/41 |
| 4,236,162 | 11/1980 | Carolus | 242/54 A |
| 4,389,203 | 6/1983 | Duntzen | 464/41 X |
| 4,436,250 | 3/1984 | Becker | 242/54 R |
| 4,633,266 | 12/1986 | Alf et al. | 343/903 |
| 4,665,406 | 5/1987 | Takizawa et al. | 343/903 |
| 4,768,991 | 9/1988 | Kopp . | |
| 4,864,322 | 9/1989 | Yamamoto et al. | 343/903 |

FOREIGN PATENT DOCUMENTS

| | | |
|---|---|---|
| 0161938 | 11/1985 | European Pat. Off. . |
| 0345002 | 12/1989 | European Pat. Off. . |
| 2064292 | 7/1971 | France . |
| 1313676 | 4/1973 | United Kingdom . |
| WO82/00183 | 1/1982 | WIPO . |

*Primary Examiner*—John M. Jillions

*Attorney, Agent, or Firm*—Frishauf, Holtz, Goodman & Woodward

[57] ABSTRACT

An apparatus for driving a rod antenna element for expansion or contraction according to the invention is characterized in that its rotary drum for winding or unwinding a base portion of a rope for expanding or contracting the antenna element is provided with a means for frictionally transmitting rotary force comprising a plurality of minute ridges and recess formed on the inner peripheral surface of the shaft bearing section in order to frictionally and directly or indirectly transmit in part the rotary force of an electric motor to the rotary drum and that the inner rope-sliding peripheral surface of a rope storage area of the rotary drum is flared from the remotest point thereof toward the rope inlet/outlet port to form a peripheral surface of a frustum of cone.

5 Claims, 2 Drawing Sheets

APPARATUS FOR DRIVING ROD ANTENNA ELEMENT FOR EXPANSION/CONTRACTION

BACKGROUND OF THE INVENTION

1. Field of the Invention

This invention relates to an apparatus for driving for expansion or contraction a rod antenna element of an expansion antenna to be suitably used on an automobile or the like and, more particularly, it relates to an improvement made on the rotary drum of an expansion antenna for reeling or unreeling a rope for expansion or contraction of the antenna.

2. Description of the Related Art

The rotary drum of an apparatus for driving a rod antenna element of an expansion antenna for expansion or contraction of the above described type is normally located coaxially with and adjacent to a rope feeding wheel (or a pinion when a rope provided with a rack is used) so that a base portion of the rope for expanding or contracting the antenna device may be wound onto or unwound from a rope storing area inside the outer peripheral wall of the drum. Such a conventional drum is normally freely rotatable relative to its shaft so that it may rotate to follow the movement of the rope base portion (which is freely movable) independent of the rotary motion of the rope feeding wheel which is normally driven by an electric motor.

The structural design of a conventional rotary drum as described above is based on the fact that, if the rotary drum is also driven by a motor so that it may rotate in synchronism with the rotation of the rope feeding wheel, there arises a difference between the peripheral speed of the rope storing area of the rotary drum and the rope feeding rate of the rotary drum to give rise to undesirable friction there. The rotary drum is inevitably made to freely rotate in order to get rid of this undesirable friction.

A conventional rotary drum of the above identified type is accompanied by certain problems as described below. As the inner surface of the rotary drum loses its original smoothness with a prolonged use, the load of winding a rope to be borne by the drum is increased. The inner surface of such a rotary drum is normally coated with a layer of grease and, therefore, well lubricated. So, the rope will move smoothly sideways in a direction parallel to the axis of the drum to ensure an even and smooth winding or unwinding operation. If the rotary drum is used for a long period of time, however, the grease is moved away from the inner surface by silt and/or sand carried in on the peripheral surface of the rope which is frequently wound and unwound so that the inner surface of the rotary drum gradually loses its original smoothness and becomes coarse. Under this condition, the operation of unwinding a rope will put a heavy load on the drum, although the load of winding a rope will not be so heavy. More specifically, the rope would not move smoothly particularly sideways in a direction parallel to the axis of the drum in the rope storage area and the force F2 required for the rope to slidingly move in that direction eventually exceeds the force (winding force) F1 applied to the rope to move it longitudinally. As a result, the rotation of the rotary drum comes to be often disrupted, emitting shaky rattling noises along with large banging noises that would be generated when the portion of the rope being wound up by the drum abruptly slides sideways in a direction parallel to the axis of the drum. Particularly in the case where the operation of the apparatus for driving a rod antenna element for expansion/contraction is controlled electronically as a function of the intensity of the electric current running through the motor circuit, any excess current running through the motor circuit is detected by the current sensor of the control system to disconnect the power supply of the motor even when the antenna element is on the way of being contracted if the increase in the load of winding the rope is too large.

SUMMARY OF THE INVENTION

In view of the above circumstances, it is therefore an object of the present invention to provide an apparatus for driving a rod antenna element of an expansion antenna for expansion or contraction that ensures a smooth operation of winding a rope onto or unwinding a rope from the rotary drum of the expansion antenna without emitting noises even if the inner surface of the rope storage area of the rotary drum has become coarse and the rope would not slide sideways in a direction parallel to the axis of the drum so that the rod antenna element may be operated smoothly for expansion and contraction even if an electronic control system is installed.

According to the invention, the above object is achieved by providing an apparatus for driving a rod antenna element of an expansion antenna for expansion or contraction having structural features as described in (1) through (3) below.

(1) There is provided a means for frictionally and directly or indirectly transmitting the rotary force of the electric motor in part or whole to the rotary drum for winding or unwinding a base portion of the rope to be used for expanding or contracting the antenna element.

(2) A following means is additionally provided in addition to the means (1).

The means for frictionally transmitting rotary force is provided with a plurality of fine ridges and recesses (e.g., produced by ribs) on the outer peripheral surface of the shaft for transmission of rotary force which is rotated by an electric motor as well as on the inner peripheral surface of the central through bore of the shaft bearing section of the rotary drum for receiving the shaft so that the rotary force of the electric motor may be directly or indirectly and frictionally transmitted in part to the rotary drum when the shaft is lightly press-fitted into the central through bore of the shaft bearing section.

(3) A following means is further additionally provided in addition to the means (1).

The inner rope-sliding periphery surface of the rope storage area of the rotary drum is flared (inversely tapered) from the remotest point of the area toward the rope inlet/outlet port to form a frustum of cone that can effectively prevent any increase in the load of winding a rope.

The provision of the means (1) through (3) gives rise to the following effects.

a. Since the rotary force of the electric motor is in part directly or indirectly and frictionally transmitted to the rotary drum, the latter is constantly driven to rotate by rotary force of a given level. As a rope is gradually introduced into the rotary drum, the rope is subjected to lateral force applied to it by the inner peripheral surface of the rotary drum that tries to move the rope sideways along the axis of the drum. Consequently, the rope is gradually moved away from the inlet/outlet port toward the inside of the rope storage area as it is wound up onto the rotary drum. In other words, the rope slidingly and smoothly moves along the axis of the rotary drum as it is wound up and any undesirable increase in the load of winding the rope can be effectively avoided.

b. Since the rotary force of the electric motor is partly transmitted to the rotary drum by the means for frictionally transmitting rotary force such as a plurality of minute ridges and recesses (e.g., produced by ribs), the means for frictionally transmitting rotary force shows a slipping motion in the rotary drum when the load of the rotary drum exceeds a certain level. Consequently, the rotary drum is not subjected to rotary force that can damage the drum. No friction can take place to undesirably damage any components of the electric motor, the power transmission system and the rotary drum.

c. Since the inner peripheral surface of the rope storage area of the rotary drum is flared toward the rope inlet/outlet port, the rope can smoothly move sideways toward the remotest point of the rope storage area. This further reduces the load of winding a rope onto the rotary drum and consequently the rope can be easily taken up by the rotary drum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed .description of the preferred embodiment given below, serve to explain the principles of the invention.

DETAILED DESCRIPTION OF THE PREFERRED EMBODIMENT

Now the present invention will be described in greater detail by referring to FIGS. 1 through 3 of the accompanying drawings that illustrate a preferred embodiment of the invention.

Figure 1:
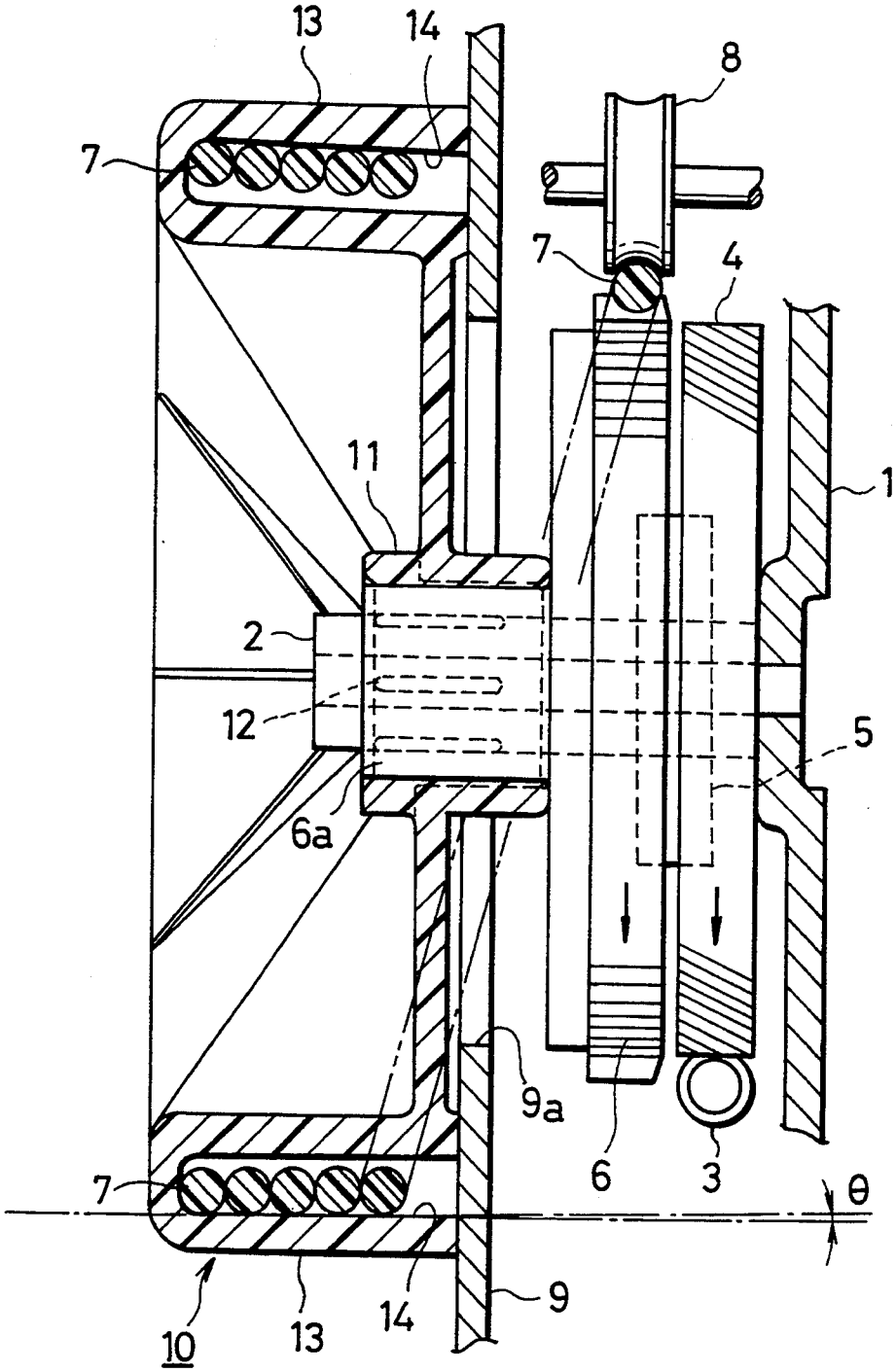
FIG. 1 is a sectional view of a preferred embodiment of the apparatus for driving a rod antenna element of an expansion antenna for expansion or contraction according to the invention.

In FIG. 1, 1 denotes part of a casing of the embodiment of the apparatus for driving an antenna element for expansion or contraction of the invention. A cylindrical shaft 2 projects from the casing 1. The shaft 2 rotatably carries on it a worm wheel 4 that engages with a worm gear 3 disposed on the rotary shaft (not shown) of an electric motor. The rotary motion of the worm wheel 4 is frictionally transmitted to a pinion 6 by way of a clutch mechanism 5. The pinion 6 is located adjacent to the worm wheel 4 and operates as a rope feeding wheel. The cylindrical shaft section 6*a* of the pinion 6 rotatably bears the shaft 2 in its central through bore and the pinion 6 rotates clockwise or counterclockwise as turning effort is applied thereto by the worm wheel 4 and moves by turn a rope 7 longitudinally by means of a gear arranged on its peripheral surface as the rope 7 is provided with a rack for expanding or contracting the antenna element that engages with the gear. The rope 7 provided with a rack is pressed against the pinion 6 by a holding roller 8 at the back side. The rope 7 provided with a rack is typically made of synthetic resin. The trailing end (not shown) of the rope 7 is connected to a telescopic rod antenna element (not shown) so that the rod antenna may be expanded or contracted by the longitudinal movement of the rope 7. The base portion or leading end of the rope 7 provided with a rack is free and made to pass through a hole 9*a* of an intermediate plate 9 arranged within the casing 1 and go to the other side of the plate 9. At the other side of the plate 9, the base portion of the rope 7 is drawn into a rope storage area 13 of a rotary drum 10 which is rotatable relative to the shaft 2 and wound around the rotary drum 10 for storage.

The rotary drum 10 is typically made of synthetic resin and provided with a shaft bearing section 11 having a central through bore 12 for receiving the cylindrical shaft section 6*a* of the pinion 6 which is lightly press fitted into the central through bore of the shaft bearing section 11. The shaft bearing section 11 is provided on its inner peripheral surface with a means for frictionally transmitting rotary force, which will be described below, for transmitting the rotary force of the pinion 6.

Figure 2:
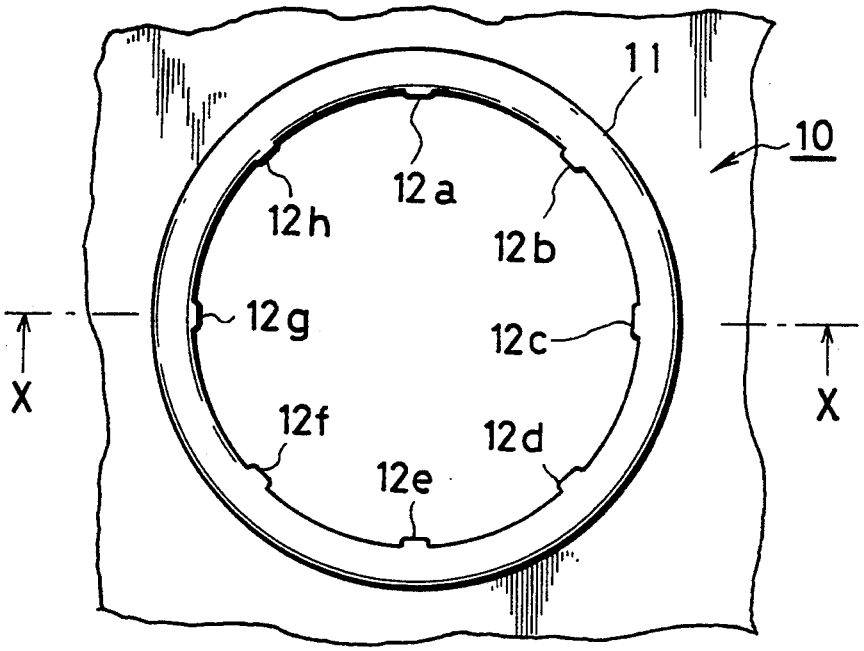
FIG. 2 is an enlarged front view of the shaft bearing section of the rotary drum of the embodiment of FIG. 1 having a central through bore.
Figure 3:
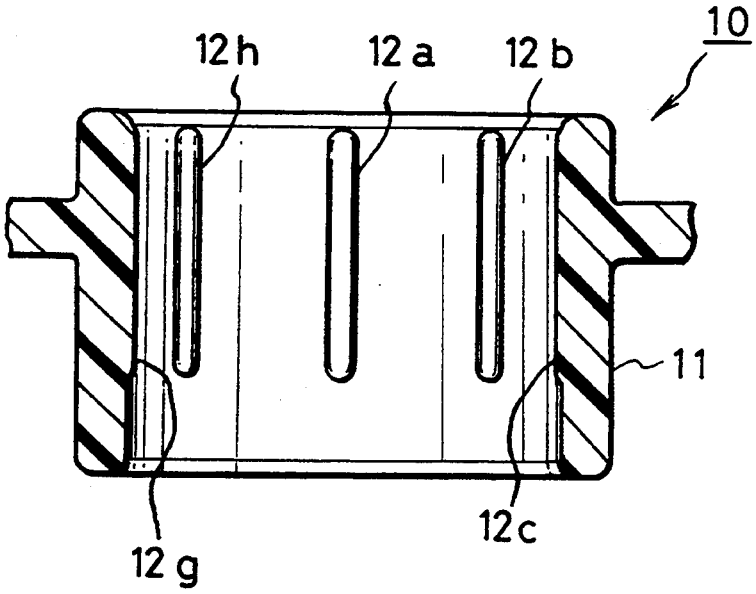
FIG. 3 is a sectional view cut along line X—X of FIG. 2.

FIG. 2 is an enlarged front view of the shaft bearing section 11 of the rotary drum 10, and FIG. 3 shows a sectional view of the shaft bearing section 11 cut along line X—X of FIG. 2. As illustrated in FIGS. 2 and 3, the shaft bearing section 11 is provided on its inner peripheral surface with a plurality of minute resilient ridges and recesses or very thin ribs 12*a* through 12*h* that constitute an element of the means for frictionally transmitting rotary force. The shaft bearing section 11 of the rotary drum 10 provided with the ribs 12*a* through 12*h* receives in its central through bore the cylindrical shaft section 6*a* of the pinion 6 which is press fitted into the central through bore as a shaft for transmitting rotary force. With such an arrangement, the rotary force of the pinion 6 is transmitted in part frictionally and efficiently to the rotary drum 10.

Returning to FIG. 1, the inner rope-sliding peripheral surface 14 of the rope storage area 13 of the rotary drum 10 is in fact the peripheral surface of a frustum of cone as it is flared (inversely tapered) from the remotest point toward the rope inlet/outlet port of the rope storage area. In other words, a longitudinal line drawn on the inner peripheral surface 14 is inclined by an angle $\theta$ (between 1° and 3° ) from the axis of the rotary drum.

Now, the operation and the effects of the embodiment of the apparatus for driving a rod antenna element of an expansion antenna for expansion or contraction of the invention having a configuration as described above will be described below.

When the electric motor (not shown) rotates in a proper direction, it applies its turning effort to the worm gear 3 and then to the worm wheel 4 to drive the latter to rotate also in the proper direction as indicated by an arrow in FIG. 1. The rotary force of the worm wheel 4 is then transmitted to the pinion 6 by way of the clutch mechanism 5. Thus, the pinion 6 is caused to rotate in the proper direction as indicated by an arrow in FIG. 1 to move the rope 7 forward. As a result, the rope 7 is unwound from the rotary drum 10 and moves longitudinally to allow the rod antenna element to expand. When the rod antenna element completes its expanding operation, the power supply for the electric motor is turned off. The electric motor stops rotating and the rod antenna element stops its expanding motion.

When, on the other hand, the electric motor (not shown) rotates in the reverse direction, the worm gear 3 rotates reversely to turn the worm wheel 4 in a direction opposite to that indicated by the arrow in FIG. 1. Then, the rotary force of the worm wheel 4 is transmitted to the pinion 6 by way of the clutch mechanism 5 to drive the pinion 6 in the reverse direction, which by turn moves the rope 7 backward. As the rope 7 moves backward, it contracts the rod antenna element and is wound up onto the rotary drum 10. When the rod antenna element completes its contracting operation, the power supply for the electric motor is turned off. The electric motor stops rotating and the rod antenna element stops its contracting motion.

In the above described operation, the rotary force of the pinion 6 that functions as a rope feeding wheel is partly and frictionally transmitted to the rotary drum 10 by way of the ribs 12*a* through 12*h* on the shaft bearing section 11 of the rotary drum 10. This means that the rotary drum 10 is rotated by rotary force of a certain level not only when the rope is drawn out of the rope storage area 13 but also when the rope is wound up onto the rotary drum 10. Thus, when the rope 7 is wound up into the rope storage area 13 of the rotary drum 10, it is subjected to rotary force applied to it by the inner peripheral surface 14 of the rotary drum 10 that tries to move it sideways along the axis of rotation of the rotary drum 10. As a result, the rope 7 is moved toward the remotest point of the rope storage area 13 as it is wound up onto the rotary drum 10 so that it smoothly moves sideways in a direction parallel to the axis of the rotary drum 10 to eliminate any undesirable increase in the load of winding the rope 7.

Since the rotary force of the electric motor is partly transmitted to the rotary drum 10 by way of the means for frictionally transmitting rotary force comprising the ribs 12*a* through 12*h*, said means for frictionally transmitting rotary force slips whenever the load of the rotary drum 10 exceeds a certain threshold level to prevent the rotary drum 10 from being subjected to any undesirable turning effort that can generate friction in various components that damages them.

Since the inner peripheral surface 14 of the rotary drum 10 is flared (inversely tapered), the rope 7 can easily move toward the remotest point of the rope storage area 13 to reduce the increase in the load of winding the rope and facilitate the operation of winding the rope.

It will be understood that the present invention is not limited to the above described embodiment. While the rotary force of the pinion 6 is partly transmitted to the rotary drum 10 in the above embodiment, the rotary force of the worm wheel 4 or the motor itself may alternatively be transmitted in part to the rotary drum 10. While minute ridges and recesses are formed on the inner peripheral surface of the shaft bearing section 11 of the rotary drum 10 as an element of the means for frictionally transmitting rotary force of the above embodiment, those minute ridges and recesses may alternatively be formed on the outer peripheral surface of the shaft (the cylindrical shaft section 6*a* of the pinion 6 of the embodiment) to be used for transmitting rotary force or on both the inner peripheral surface of the shaft bearing section 11 and the outer peripheral surface of the cylindrical shaft section 6*a*.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for driving a rod antenna element for expansion or contraction, comprising:
   - a worm wheel for decreasing a rotating speed of an electric motor, said worm wheel being engaged with a worm gear disposed on a rotary shaft of the electric motor;
   - a rope feeding wheel for feeding a rope having a base portion, said rope feeding wheel being indirectly rotated by a rotary force transmitted to said rope feeding wheel from said worm wheel;
   - a clutch mechanism for transmitting the rotary force transmitted from said worm wheel to said rope feeding wheel;
   - a rope for expanding or contracting said rod antenna element, said rope having a trailing end and being arranged to be longitudinally moved by said rope feeding wheel to drive said rod antenna element for expansion or contraction by said trailing end of said rope, said rope further having a free leading end at said base portion of said rope;
   - a rotary drum for winding or unwinding said base portion and a succeeding portion of said rope by a predetermined length for expanding or contracting said rod antenna element; and
   - means for frictionally transmitting a rotary force for frictionally and directly or indirectly transmitting the rotary force of said electric motor in part to said rotary drum.

2. The apparatus of claim 1, wherein said means for frictionally transmitting a rotary force comprises ridges and recesses formed on an outer peripheral surface of a rotary force transmitting shaft which is arranged to be rotated by a turning of one of (a) the electric motor and (b) an inner peripheral surface of a shaft bearing section of said rotary drum, for receiving said shaft.

3. The apparatus of claim 2, wherein said ridges and recesses are small.

4. The apparatus of claim 2, wherein said ridges and recesses are minute.

5. The apparatus of claim 1, wherein said rotary drum comprises a rope storage area, said rope storage area having an inner rope-sliding surface which is flared from a remotest point thereof toward a rope inlet/outlet port thereof, to form a frusto conical peripheral surface.

* * * * *